US008159122B2

(12) United States Patent
Yamazaki et al.

(10) Patent No.: US 8,159,122 B2
(45) Date of Patent: Apr. 17, 2012

(54) LIGHT-EMITTING SUBSTRATE AND DISPLAY APPARATUS USING THE SAME

(75) Inventors: Koji Yamazaki, Ayase (JP); Norihiro Suzuki, Yokohama (JP); Yasuyuki Todokoro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 12/327,863

(22) Filed: Dec. 4, 2008

(65) Prior Publication Data

US 2009/0160313 A1 Jun. 25, 2009

(30) Foreign Application Priority Data

Dec. 20, 2007 (JP) ..... 2007-328721

(51) Int. Cl.
*H01J 1/62* (2006.01)
*H01J 63/04* (2006.01)

(52) U.S. Cl. ..... 313/495; 313/309; 313/346 R

(58) Field of Classification Search ..... 313/495–497, 313/309–311, 336, 351, 346 R
See application file for complete search history.

(56) References Cited

U.S. PATENT DOCUMENTS

| | | | | |
|---|---|---|---|---|
| 6,225,749 | B1 | 5/2001 | Kobayashi et al. | 315/169.3 |
| 6,445,367 | B1 | 9/2002 | Suzuki et al. | 345/75.2 |
| 6,509,691 | B2 | 1/2003 | Yamazaki et al. | 315/169.3 |
| 6,534,924 | B1 | 3/2003 | Oguchi et al. | 315/169.1 |
| 6,853,148 | B2 | 2/2005 | Yamazaki et al. | 315/169.3 |
| 6,879,096 | B1 | 4/2005 | Miyazaki et al. | 313/495 |
| 6,896,571 | B2 | 5/2005 | Mizuno et al. | 445/24 |
| 7,053,537 | B2 | 5/2006 | Hiroike et al. | 313/292 |
| 7,077,716 | B2 | 7/2006 | Mizuno et al. | 445/24 |
| 7,135,823 | B2 | 11/2006 | Suzuki et al. | 315/160 |
| 7,157,850 | B2 | 1/2007 | Miyazaki et al. | 313/495 |
| 7,247,981 | B2 | 7/2007 | Yamazaki | 313/497 |
| 7,323,814 | B2 | 1/2008 | Miyazaki et al. | 313/495 |
| 7,391,149 | B2 | 6/2008 | Yamazaki | 313/495 |
| 7,400,082 | B2 | 7/2008 | Suzuki et al. | 313/473 |
| 7,537,503 | B2 | 5/2009 | Hiroike et al. | 445/24 |
| 7,626,325 | B2 | 12/2009 | Murata et al. | |

(Continued)

FOREIGN PATENT DOCUMENTS

CN 1329458 A 1/2002

(Continued)

OTHER PUBLICATIONS

Chinese Notification of First Office Action dated Jan. 15, 2010, regarding Application No. 200810186441X.

(Continued)

*Primary Examiner* — Joseph L Williams
*Assistant Examiner* — Kevin Quarterman
(74) *Attorney, Agent, or Firm* — Fitzpatrick, Cella, Harper & Scinto

(57) ABSTRACT

A light-emitting substrate includes a substrate, a plurality of light-emitting members arranged on the substrate in a matrix pattern, a partition arranged between respective adjacent ones of the plurality of light-emitting members and projecting relative to a surface of the substrate to a position higher than the light-emitting members, a plurality of conductors each covering at least one of the light-emitting members and arranged in a matrix pattern in a mutually spaced relation, and a resistor electrically interconnecting the plurality of conductors. The resistor has a column stripe portion extending in a column direction, and the column stripe portion is positioned on the partition.

8 Claims, 10 Drawing Sheets

U.S. PATENT DOCUMENTS

| | | | | |
|---|---|---|---|---|
| 2005/0189866 | A1* | 9/2005 | Kodera et al. | 313/495 |
| 2006/0103294 | A1 | 5/2006 | Suzuki et al. | |
| 2006/0181194 | A1* | 8/2006 | Murata et al. | 313/496 |
| 2007/0126339 | A1 | 6/2007 | Kato et al. | 313/496 |
| 2007/0200486 | A1* | 8/2007 | Okanan et al. | 313/496 |
| 2007/0246747 | A1 | 10/2007 | Murata et al. | |
| 2007/0267953 | A1* | 11/2007 | Seki | 313/292 |
| 2008/0024050 | A1* | 1/2008 | Kobayashi | 313/495 |
| 2008/0048551 | A1* | 2/2008 | Kijima et al. | 313/495 |
| 2008/0079349 | A1 | 4/2008 | Miyazaki et al. | 313/495 |

FOREIGN PATENT DOCUMENTS

| | | | |
|---|---|---|---|
| EP | 1 638 129 | A2 | 3/2006 |
| EP | 1 833 073 | A1 | 12/2007 |
| JP | 2003-229074 | | 8/2003 |
| JP | 2004-158232 | | 6/2004 |
| JP | 2006120622 | A2 | 5/2006 |
| JP | 2006173094 | A | 6/2006 |
| JP | 2007-134084 | | 5/2007 |
| JP | 2007134084 | A * | 5/2007 |

OTHER PUBLICATIONS

European Search Report issued in the counterpart application No. 08020873.9 dated Mar. 24, 2010.

* cited by examiner

LIGHT-EMITTING SUBSTRATE AND DISPLAY APPARATUS USING THE SAME

BACKGROUND OF THE INVENTION

1. Field of the Invention

The present invention relates to a flat image display apparatus utilizing an electron beam, such as a field emission display (FED). More particularly, the present invention relates to a light-emitting screen structure which emits light upon irradiation of an electron beam to display an image, and an image display apparatus using the light-emitting screen structure.

2. Description of the Related Art

Hitherto, electron-emitting devices have been utilized in an image display apparatus. For example, there is known a display panel in which an electron source substrate having a large number of electron-emitting devices formed thereon is arranged to face an opposite substrate including phosphors and a metal back for accelerating electrons emitted from the electron-emitting devices. The interior of the display panel is evacuated to a vacuum state. Such a flat electron-beam display panel is advantageous in reducing weight and increasing a screen size as compared with CRT (cathode ray tube) display apparatuses which have been widely used so far. Further, the flat electron-beam display panel can provide an image with higher brightness and higher quality than other flat display panels, such as a flat display panel using a liquid crystal, a plasma display, and an electroluminescent display.

In the display apparatus of the type applying a voltage between the opposite electrode and the electron-emitting devices to accelerate electrons emitted from the cold-cathode electron-emitting devices, a higher voltage is advantageously applied to maximize the brightness of the emitted light. Also, depending on the type of the electron-emitting devices, the emitted electron beam diverges until reaching the opposite electrode. From the viewpoint of realizing a display with higher resolution, therefore, it is advantageous that the distance between the electron source substrate and the opposite substrate is set to be small.

However, because the shorter distance between both the substrates necessarily generates a higher electric field in a space between both the substrates, the electron-emitting device can, in some occasions, become damaged due to an accidental discharge. In such a case, a current flows through the phosphor while the current concentrates in its part, thus causing a display screen to be partly brighter.

In order to solve the above-mentioned problems, it is required to reduce the probability of the accidental discharge or to make the discharge breakdown harder to occur.

Japanese Patent Laid-Open No. 2006-120622 (corresponding to EP 1638129A) and Japanese Patent Laid-Open No. 2006-173094 (corresponding to US 2006/0103294) disclose display apparatuses in which the discharge breakdown is made harder to occur. In the disclosed display apparatuses, a metal back is two-dimensionally divided into parts, which are interconnected through strip- or grid-shaped resistors, to thereby reduce a discharge current that flows in the event of an accidental discharge.

However, each of the image display apparatus disclosed in Japanese Patent Laid-Open No. 2006-120622 and No. 2006-173094 needs to be further improved not only in increasing the brightness, but also in realizing higher definition and higher quality of the displayed image.

SUMMARY OF THE INVENTION

An exemplary embodiment of the present invention provides a light-emitting substrate capable of suppressing a discharge current that flows in the event of an accidental discharge, and of presenting an image with higher definition and higher contrast, and a high-spec (high-performance) image display apparatus using the light-emitting substrate, as compared to existing devices.

According to one exemplary embodiment of the present invention, there is provided a light-emitting substrate including a substrate, a plurality of light-emitting members arranged on the substrate in a matrix pattern, a partition arranged between respective adjacent ones of the plurality of light-emitting members and projecting relative to a surface of the substrate to a position higher than the light-emitting members, a plurality of conductors each covering at least one of the light-emitting members and arranged in a matrix pattern in a mutually spaced relation, and a resistor electrically interconnecting the plurality of conductors. The resistor has a column stripe portion extending in a column direction, and the column stripe portion is positioned on the partition.

According to another exemplary embodiment of the present invention, there is provided an image display apparatus including an electron source substrate including a plurality of electron-emitting devices and wirings arranged to apply voltages to the electron-emitting devices, and a light-emitting substrate. The light-emitting substrate includes a substrate, a plurality of light-emitting members arranged on the substrate in a matrix pattern, the light-emitting members emitting light in response to being irradiated by electrons emitted by at least one electron-emitting device, a partition arranged between respective adjacent ones of the plurality of light-emitting members and projecting relative to a surface of the substrate to a position higher than the light-emitting members, a plurality of conductors each covering at least one of the light-emitting members and arranged in a matrix pattern in a mutually spaced relation, and a resistor electrically interconnecting the plurality of conductors. The resistor has a column stripe portion extending in a column direction, and the column stripe portion is positioned on the partition.

According to the exemplary embodiments of the present invention, in the event of an accidental discharge, the resistor acts to suppress a rise of a discharge current, thereby preventing a breakdown or damage caused by the accidental discharge. Also, since the resistor does not block the light emitted from the light-emitting member, the brightness of the emitted light can be increased. Further, since an anode voltage is applied to the partition (rib), the distance between a cathode and an anode can be apparently reduced, whereby spreading of an electron beam can be suppressed and an image can be displayed with higher definition. The application of the anode voltage to an upper surface of the partition suppresses the spreading of the electron beam, whereas it increases the intensity of an electric field between the anode and the cathode, thus resulting in a higher possibility of causing a discharge. However, since the resistor serves as a member for specifying the potential at the upper surface of the partition which is positioned, on the light-emitting substrate (face plate) side, closest to the cathode, the resistor develops in itself the function of suppressing a rise of the discharge current and serves to prevent a breakdown caused by the discharge. In addition, since the partition acts to suppress a halation, a display image can be provided with high contrast and high quality.

Further features of the present invention will become apparent from the following description of exemplary embodiments with reference to the attached drawings.

BRIEF DESCRIPTION OF THE DRAWINGS

FIG. 3, including

FIG. 4, including

FIG. 5, including

FIG. 6, including

FIG. 7, including

DESCRIPTION OF THE EMBODIMENTS

Exemplary embodiments of the present invention will be described below.

A light-emitting substrate according to an exemplary embodiment of the present invention can be applied to a face plate for an electron-beam display apparatus, e.g., an FED, or another type of display device. In the FED, the diameter of an electron beam can be easily narrowed, and color reproducibility is remarkably improved by suppressing a halation. On the other hand, a sufficient discharge-withstand performance can be useful in the FED because a high electric field is produced between an anode and a cathode. Thus, the face plate for the FED is one advantageous example to which the light-emitting substrate according to the exemplary embodiment of the present invention is applied.

Several exemplary embodiments of the present invention will be described in detail with reference to the drawings, particularly, taking as an example an image display apparatus (hereinafter referred to as an "SED") using surface-conduction electron-emitting devices among various types of FEDs.

Figure 1A:
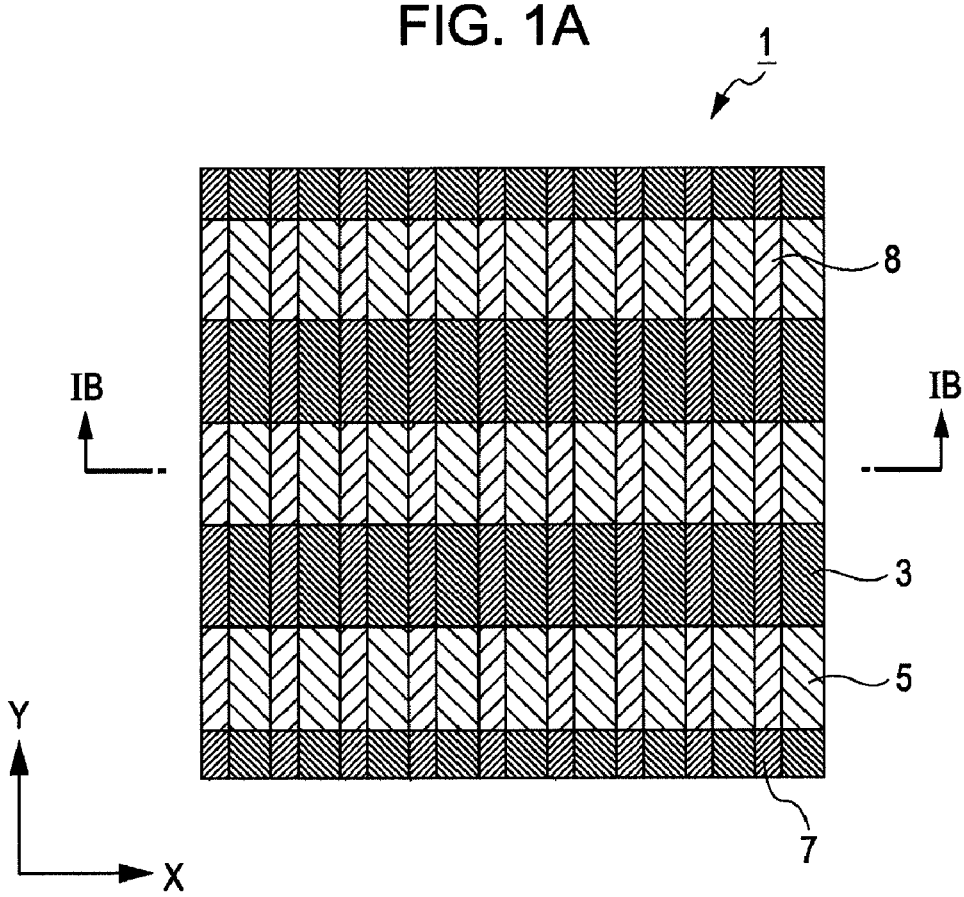
FIGS. 1A and 1B are respectively an inner-surface plan view and a sectional view of a light-emitting substrate according to one exemplary embodiment of the present invention.
Figure 1B:
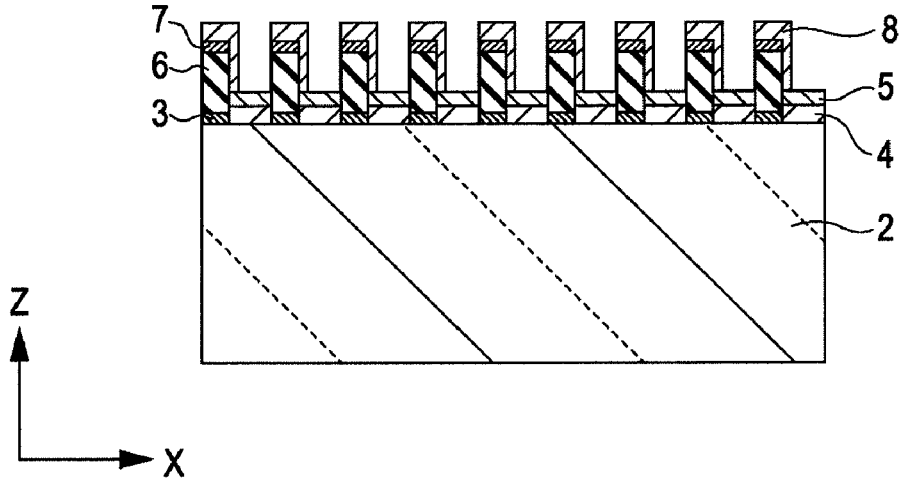

FIG. 1A is an inner-surface plan view of a face plate, and FIG. 1B is a sectional view taken along the line IB-IB in FIG. 1A. The construction of a face plate 1 will be described below.

Figure 2:
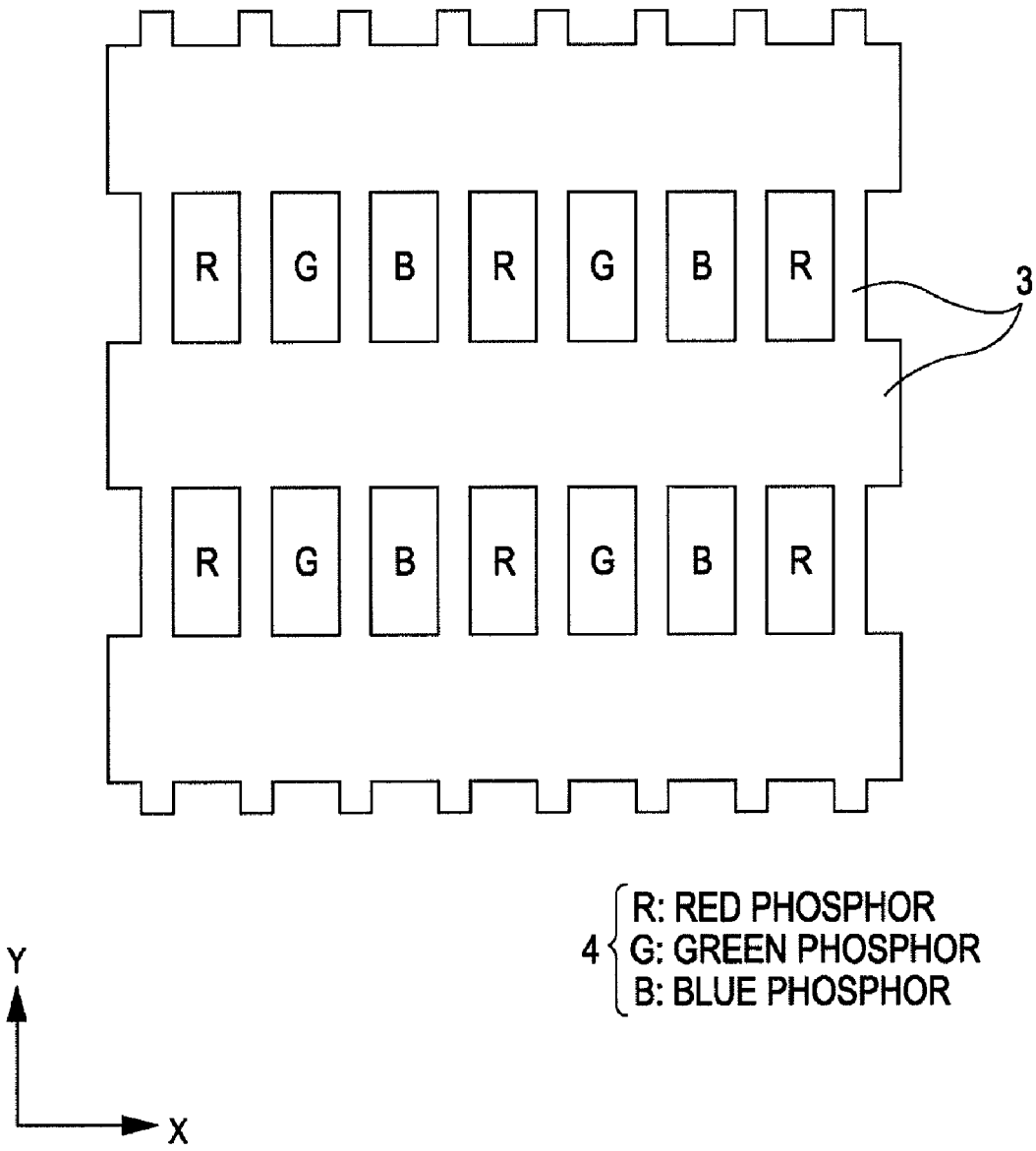
FIG. 2 illustrates a separately coated pattern of phosphors.

A substrate 2 of the face plate 1 is advantageously formed of a glass substrate from the viewpoint of maintaining a vacuum and ensuring sufficient strength. The face plate 1 includes a black member 3, a phosphor 4 serving as a light-emitting member, and a metal back 5 made of a conductor. The black member 3 is formed in a grid-like shape having openings. The phosphors 4 are disposed in the openings and are arranged on the substrate in a matrix pattern. FIG. 2 illustrates the matrix pattern of the phosphors arranged in the openings of the grid-shaped black member 3. To suppress a discharge current that flows in the event of an accidental discharge, the metal back 5 is divided per sub-pixel (e.g., R of RGB=Red, Green and Blue) such that divided metal backs are arranged in a matrix pattern in a mutually spaced relation.

Further, in FIGS. 1A and 1B, partitions (hereinafter referred to as "ribs") 6 projecting from the substrate surface are disposed between the adjacent light-emitting members 4 on parts of the black member 3 which are extended in the Y (column) direction. The ribs 6 have the function of suppressing a halation, and the height of each rib is selected as appropriate depending on the pixel size, the anode voltage, etc. A resistor 7 for supplying an anode potential is formed on the rib 6 to extend in the shape of a stripe in the Y (column) direction. In addition, a metal-back power supply member 8 for electrically connecting the resistor 7 to each of the divided metal backs 5 is extended from the resistor 7 for connection to the metal back 5 through a lateral surface of the rib 6.

The ribs 6 can be formed by using one of the known processes, such as stacking a printed pattern, blasting a thick film, and slit coating, or the like. Among those known processes, blasting a thick film is advantageous from the viewpoints of productivity, accuracy, and adaptation to a larger screen.

The resistors 7 can be formed by using one of the known processes, such as pattern printing and application with a dispenser, or the like. Among those known processes, pattern printing is advantageous from the viewpoints of accuracy and productivity.

Further, the metal back 5 and the metal-back power supply member 8 can be formed in the desired pattern by using a known film forming method with masking or etching, or the like. Among the known methods, vapor deposition with masking is a simple and easy method to use.

More advantageously, the ribs 6 are formed in a grid-like shape, as shown in FIG. 3, because the grid-like shape of the ribs 6 is effective in suppressing a halation in two-dimensional directions.

Further, as shown in FIG. 4, the resistor 7 can be formed every plural partitions (e.g., one resistor is formed every three partitions in FIG. 4 and such an arrangement is also called a "reduction in the number of resistors" hereinafter) such that plural ones of the divided metal backs 5 are interconnected as a group by the metal-back power supply members 8 and one resistor 7 is connected to each group of the interconnected metal backs. In the event of a discharge, because a potential difference is caused between the adjacent resistors 7, a secondary creeping discharge may occur on the ribs 6 in the grid-like shape. By reducing the number of resistors as mentioned above, the distance between the adjacent resistors can be increased so as to weaken the intensity of a resulting electric field and to suppress the secondary creeping discharge. Thus, reducing the number of resistors is an effective method for holding the discharge-withstand performance at a desired level depending on the anode voltage and the pixel size.

Moreover, as shown in FIG. 5, the resistor 7 is advantageously positioned intermediate the metal backs 5 which are positioned adjacent to each other and which are interconnected by the metal-back power supply members 8. With such an arrangement, one rib (denoted by 6*a* in FIG. 5) is disposed between the metal backs 5 which are positioned adjacent to each other, but which are not interconnected. Therefore, the creeping distance between the metal backs 5 which are positioned adjacent to each other, but which are not interconnected can be increased. In addition, because ends of the metal backs which are positioned adjacent to each other, but which are not interconnected are not in a directly opposed relation, it is possible to prevent a secondary discharge that would otherwise occur between the metal backs which are positioned adjacent to each other, but which are not interconnected.

FIG. 6 shows another method for weakening the intensity of the electric field between the adjacent resistors. More specifically, the intensity of the electric field between the adjacent resistors can be effectively reduced, as shown in FIG. 6, by arranging the resistors in a grid-like shape made up of stripe portions extending in the Y direction (i.e., column stripe portions extending in the column direction) and stripe portions extending in the X direction (i.e., row stripe portions extending in the row direction). Stated another way, while the arrangement of FIG. 5 is intended to ensure insulation between the adjacent metal backs 5, the arrangement of FIG. 6 is intended to moderate the potential difference. Thus, in the arrangement of FIG. 6, a weak current is caused to flow between the adjacent metal backs 5 when a discharge is generated between the metal back and an electron-emitting device. As a result, the potential difference between the adjacent metal backs 5 is held to be fairly small, whereby a short circuit due to the secondary discharge can be prevented. Further, a more reliable discharge-withstand performance can be obtained by combining, as shown in FIG. 7, the arrangement of reducing the number of resistors 7 (FIG. 5) and the arrangement of the resistors 7 in the grid-like shape (FIG. 6).

The resistor 7 is advantageously formed of a thick-film resistance member that is molten and short-circuited so as to have a low resistance when a discharge current exceeds the current capacity. For example, when the resistor 7 has variations in film thickness, a discharge current may partially exceed the current capacity of the resistor in the event of an accidental discharge. In such a case, if the resistor 7 is electrically disconnected like a fuse, electric power can no longer be supplied to the metal back 5. For that reason, the resistor 7 is advantageously made of a material that is short-circuited when the discharge current exceeds the current capacity.

Figure 8:
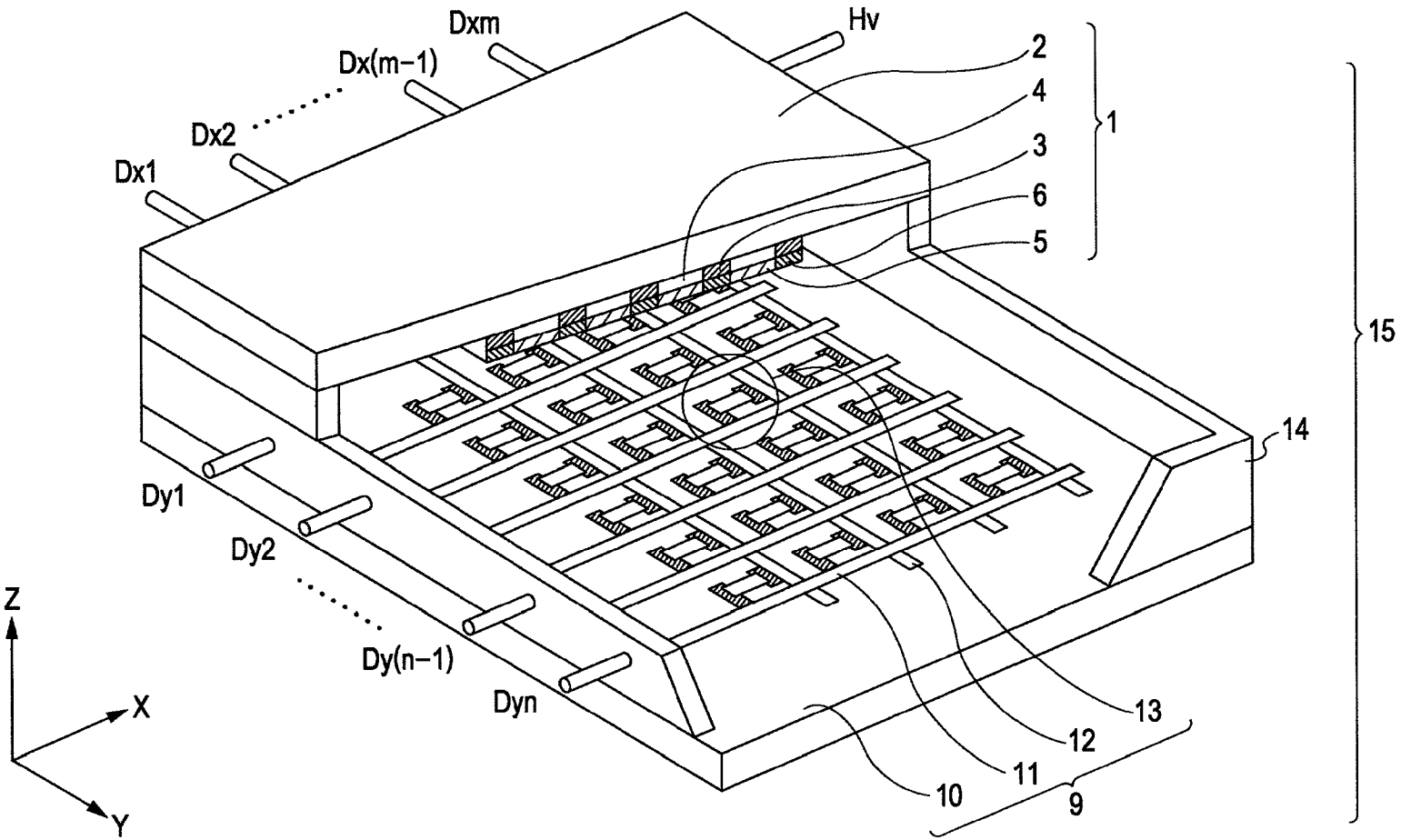
FIG. 8 is a perspective view, partly cut away, of an image display apparatus using a light-emitting substrate according to an exemplary embodiment of the present invention.

FIG. 8 illustrates an image display apparatus (SED) employing a face plate according to an example aspect of the invention. Referring to FIG. 8, a rear plate (electron source substrate) 9 is constituted by a glass substrate 10, scanning wirings 11, signal wirings 12, and surface-conduction electron-emitting devices (hereinafter referred to as "SCEs") 13. The scanning wirings 11 are formed in number N, the signal wirings 12 are formed in number M, and the SCEs 13 are formed in number (N×M). N and M are each a positive integer and are set as appropriate depending on the desired number of display pixels. In the case of FHD (Full High-Definition), for example, N=1080 and M=1920×3=5760 are set. Further, in FIG. 8, an outer frame 14 forms a vacuum container 15 together with the face plate 1 and the rear plate 9. The image display apparatus (SED) also can include a high-voltage power supply, a drive circuit, etc. (not shown) connected to the vacuum container 15. More specifically, the metal back 5 is electrically connected to an Hv terminal of the vacuum container 15 through the metal-back power supply member 8 and the resistor 7 so that a high voltage of about 1 kV to 15 kV is applied to the metal back 5 from the high-voltage power supply. The scanning wirings 11 and the signal wirings 12 are electrically connected to terminals Dyn (n=1 to N) and Dxm (m=1 to M) of the vacuum container 15 and are supplied with scanning signals and image signals from the drive circuit, respectively. Each SCE 13 emits electrons corresponding to a signal applied to it. The emitted electrons are attracted by the potential applied to the metal back 5, and then pass through the metal back 5, thus causing the phosphor 4 to emit light. The brightness of the emitted light can be adjusted depending on the applied high voltage and signal. In the display apparatus using the light-emitting substrate according to the exemplary embodiment of the present invention, since the metal back 5 is divided into the matrix pattern, the scale of a discharge can be held small. Also, since the projections (ribs) are projected from the substrate surface between the light-emitting members (phosphors) and the resistors 7 applied with the anode voltage are disposed on the partitions, the distance between the cathode and the anode can be apparently reduced and hence spreading of the electron beam is suppressed. The application of the anode voltage to an upper surface of the partition suppresses the spreading of the electron beam, whereas it increases the intensity of the electric field between the anode and the cathode, thus resulting in a higher possibility of causing a discharge. However, since the resistor is disposed on the upper surface of the partition which is projected on the light-emitting substrate (face plate) so as to approach the cathode, the resistor has in itself the function of suppressing a rise of the discharge current and serves to prevent a breakdown or damage caused by the discharge. Also, since the resistor for supplying electric power to the metal back is not positioned below (overlapped with) the light-emitting member (phosphor), the resistor does not block the emitted light, whereby the brightness of the emitted light can be increased. Further, the emitted electrons may be partly diffused on and reflected by the face plate such that part of the diffused and reflected electrons causes the phosphor to emit light again, thereby generating the so-called halation. By using the above-described light-emitting substrate according to the exemplary embodiment of the present invention, however, since the partition traps the diffused and reflected electrons, the halation can be suppressed and an image display apparatus having a superior discharge-withstand performance can be provided.

Figure 9:
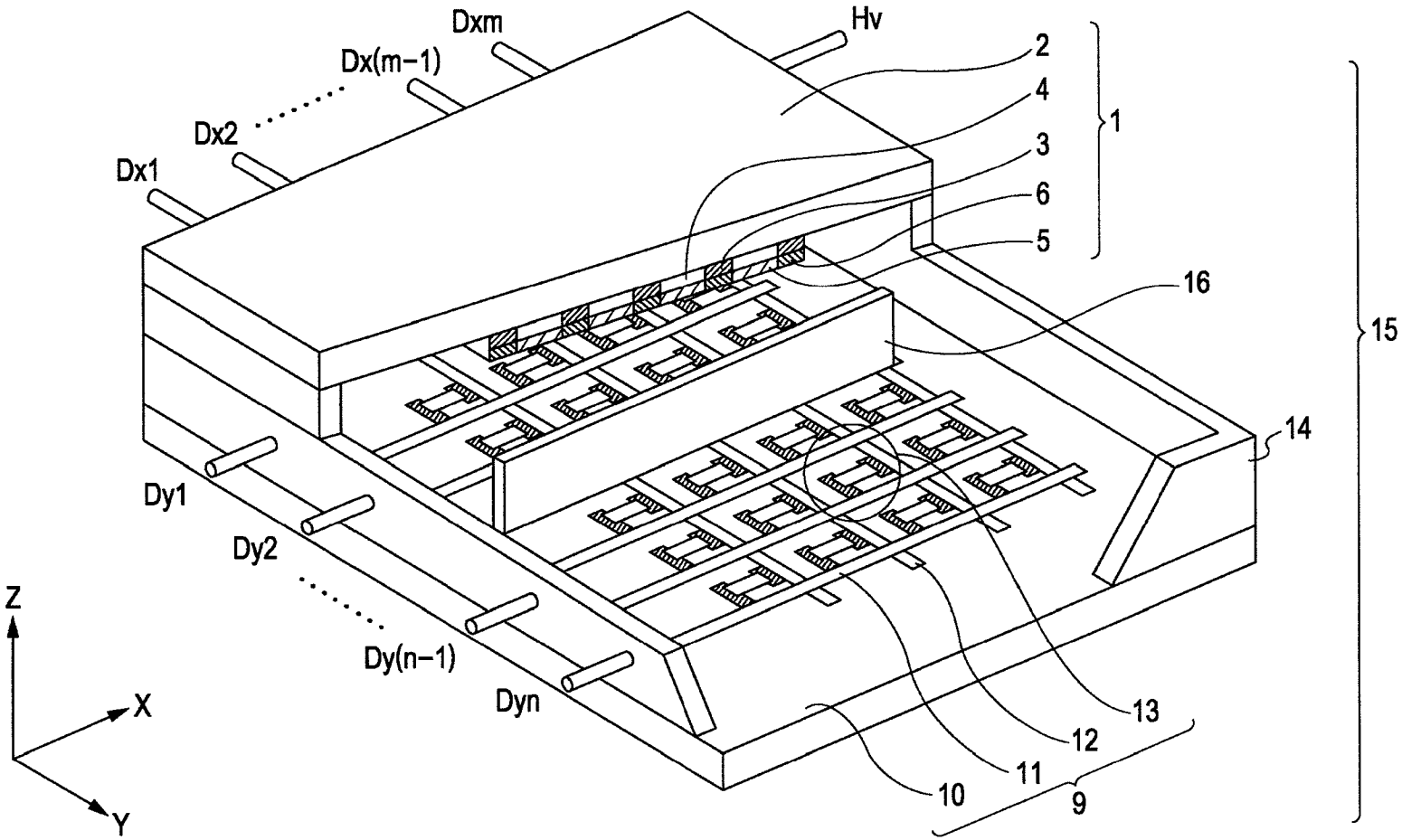
FIG. 9 is a perspective view, partly cut away, of an image display apparatus using a light-emitting substrate according to an exemplary embodiment of the present invention and including a spacer structure.

When the image display apparatus has a large size, at least one spacer 16 for supporting the vacuum container 15 against the atmospheric pressure can be disposed in the panel, as shown in FIG. 9. In such a case, the spacer 16 can be formed of a high-resistance member that allows a weak current to flow through it, for the purpose of preventing charging on the spacer. Further, the spacer 16 can be held at a desired potential by directly connecting a portion of the resistor 7 on the rib 6 of the light-emitting substrate and the spacer 16 to each other, or electrically connecting them through a conductor.

EXAMPLES

Example 1

This exemplary embodiment represents an example of the light-emitting substrate shown in FIGS. 1A and 1B. FIG. 1A illustrates an inner surface of the light-emitting substrate, and FIG. 1B illustrates a cross-section thereof taken along the line IB-IB in FIG. 1A.

The light-emitting substrate of Example 1 is fabricated as follows.

A black paste (NP-7803D made by Noritake Co., Ltd.) is coated on the surface of a cleaned glass substrate by screen printing into such a grid-like shape that only desired portions in a light-emitting area of the substrate surface are opened. After drying the substrate at 120° C., it is fired at 550° C. to form the black member 3 with a thickness of 5 μm. The pitches of the openings are set to the same values as that of the electron-emitting devices on the rear plate, i.e., 450 μm in the Y direction and 150 μm in the X direction, and the opening size is set to 220 μm in the Y direction and 90 μm in the X direction.

Next, a bismuth oxide-based insulating paste (NP7753 made by Noritake Co., Ltd.) constituting a main structural member of the rib structure in a final state is coated on the substrate by using a slit coater so as to provide a film thickness of 200 μm after firing. The coated insulating paste is dried for 10 minutes at 120° C.

Over the coated insulating paste, a high-resistance paste mixed with ruthenium oxide is formed by screen printing so as to provide a film thickness of 10 μm after firing. The coated high-resistance paste is dried for 10 minutes at 120° C. While a high-resistance layer is printed over the entire image area in this example, the high-resistance paste may be applied by pattern printing, instead of coating it over the entire image area, to be coated only on portions which will be left in the final state after sand blasting (described later). The material used for forming the high-resistance layer is coated on a test pattern and its resistance value is measured. As a result, the volume resistivity of the material is approximately $10^{-1}$ Ω·m.

Next, a dry film resist (DFR) is applied by using a laminator. Further, the DFR is subjected to pattern exposure with a chromium exposure mask aligned at a predetermined position. The alignment is performed by using an alignment mark (not shown) arranged outside the image forming area. The exposure pattern is formed in a striped shape extending parallel to the long side of the opening of the black member 3 (i.e., extending in the Y direction) and having a width of 50 μm in an overlying relation to the black member 3 (i.e., having an opening width of 100 μm). A sand blasting mask having openings at desired positions is formed through the steps of applying a development liquid for the DFR, showering a rinse, and drying. The high-resistance paste and the insulating paste are removed from unnecessary portions corresponding to the openings of the DFR by the sand blasting with SUS grains used as abrasives. Then, the DFR is peeled off by showering a peeling liquid. After washing, the substrate is fired at 530° C., whereby the insulating ribs 6 and the resistors 7 are formed.

Next, phosphors are applied to light-emitting areas by screen printing in such a manner as causing a paste, which contains P22 phosphors dispersed therein and which is commonly used in the CRT field, to be dropped onto the light-emitting areas in match with the rib structure having the openings in the striped pattern. In this example, the phosphors in three RGB colors are separately coated in individual stripes to provide a color display. The film thickness of each phosphor is set to 15 μm. After the printing, the phosphors in three RGB colors are dried at 120° C. The drying of the phosphors can be performed for each color or together for all three colors. Thereafter, an aqueous solution containing alkali silicate acting as a bonding material in a later stage, i.e., the so-called liquid glass, is coated by spraying.

Next, an acrylic emulsion is applied by a spray coating process and then dried to fill gaps between phosphor powders with acrylic resin. An aluminum film serving as the metal back 5 is coated thereon by vapor deposition. At that time, the metal pack 5 is formed only in the light-emitting areas by using a metal mask having openings only in portions respectively corresponding to the light-emitting areas. The thickness of the aluminum film is set to 100 μm. Then, the substrate is heated to 450° C. to decompose and remove the acrylic resin.

Finally, the metal-back power supply members 8 are formed by obliquely vapor-depositing an aluminum film from one direction while a metal mask having stripes extending in the X direction is used to form the aluminum film in match with the openings, i.e., the light-emitting areas, and in a pattern separated in the Y direction. The metal-back power supply members 8 can also be made of titanium, chromium or the like other than aluminum.

In addition, a high-voltage introducing terminal is formed so as to penetrate the light-emitting substrate 1 via a through-hole bored therein, and the high-voltage introducing terminal is connected to the resistors 7 at the edge of the image forming area (though not shown).

An SED is fabricated by using the light-emitting substrate 1 of Example 1 fabricated as described above, and an image is displayed by applying a voltage of 8 kV to the metal backs 5 through the resistors 7. The displayed image is satisfactory in points of having high definition and high brightness, and of causing less color mixing due to a halation.

Further, a test of applying an excessive voltage to particular one of the electron-emitting devices so as to intentionally cause a device breakdown and to induce a discharge between the relevant electron-emitting device and the light-emitting substrate 1 has proved that a discharge current is sufficiently restricted and the other electron-emitting devices surrounding the intentionally damaged electron-emitting device remain normal.

Example 2

Figure 3A:
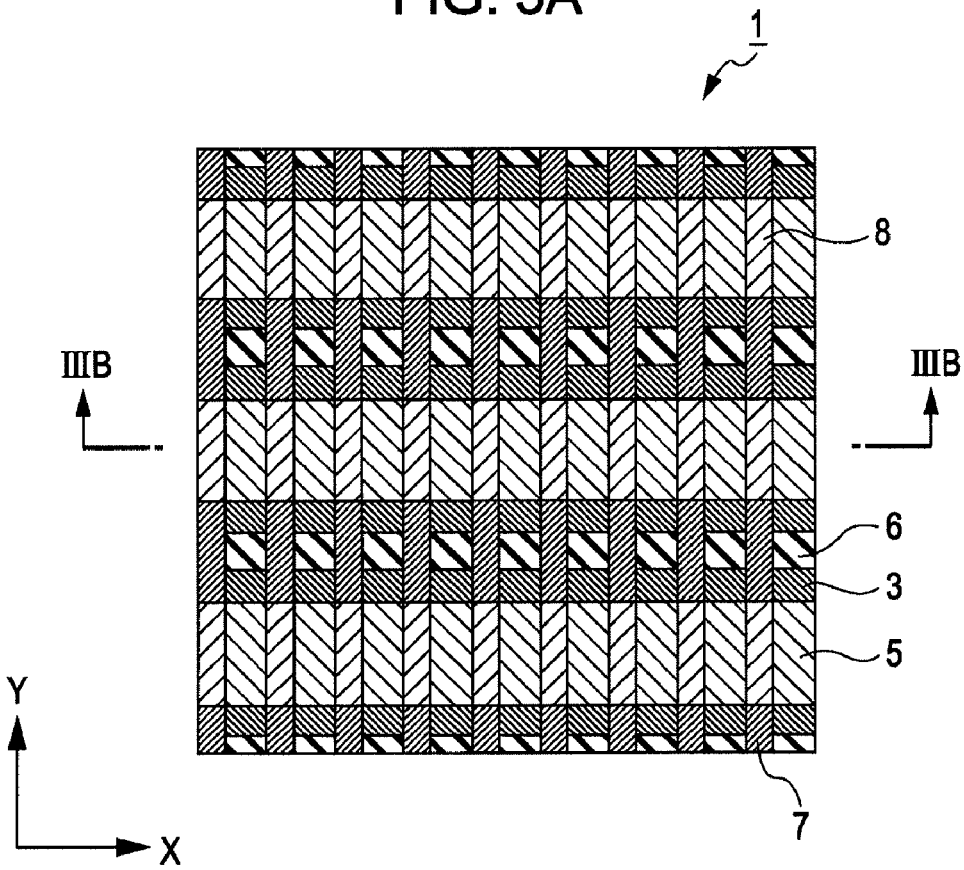
FIGS. 3A and 3B, shows respectively an inner-surface plan view and a sectional view of a light-emitting substrate according to another exemplary embodiment of the present invention.
Figure 3B:
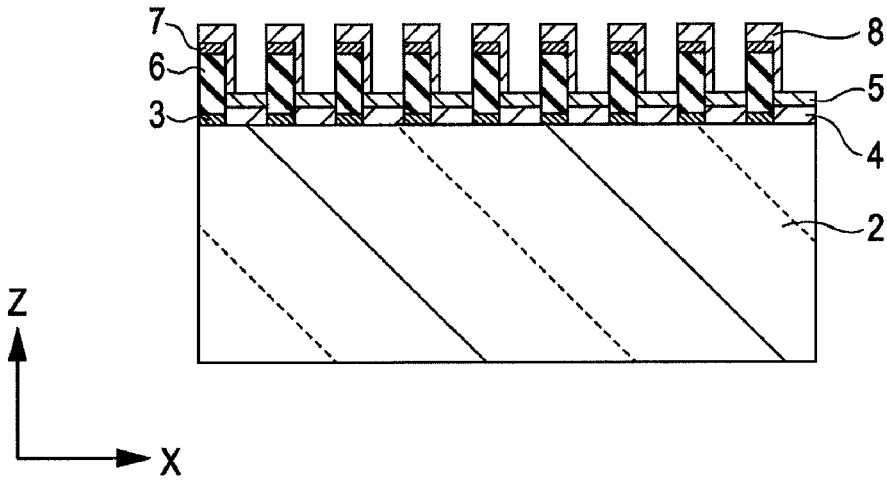

This exemplary embodiment represents an example of the light-emitting substrate shown in FIGS. 3A and 3B. FIG. 3A illustrates an inner surface of the light-emitting substrate, and FIG. 3B illustrates a cross-section thereof taken along the line IIIB-IIIB in FIG. 3A.

Example 2 differs from Example 1 in that the ribs 6 are formed in a grid-like shape extending not only in the Y direction, but also in the X direction. Stated another way, the ribs 6 are formed to extend in the X direction as well with a rib width of 50 μm in an overlapping relation to the black member 3. Further, the resistors 7 are formed in a striped pattern by screen printing using the high-resistance paste mixed with ruthenium oxide.

An SED is fabricated by using the light-emitting substrate 1 of Example 2, and an image is displayed by applying a voltage of 8 kV to the metal backs 5 through the resistors 7. The displayed image is satisfactory in points of having high definition and high brightness, and of causing less color mixing due to a halation. In addition, since a halation in the Y direction is also suppressed, lines in the X direction can be more clearly displayed with less blur than the lines displayed in Example 1.

Further, a test of applying an excessive voltage to particular one of the electron-emitting devices so as to intentionally cause a device breakdown and to induce a discharge between the relevant electron-emitting device and the light-emitting substrate 1 has proved that a discharge current is sufficiently restricted and the other electron-emitting devices surrounding the intentionally damaged electron-emitting device remain normal.

Example 3

Figure 4A:
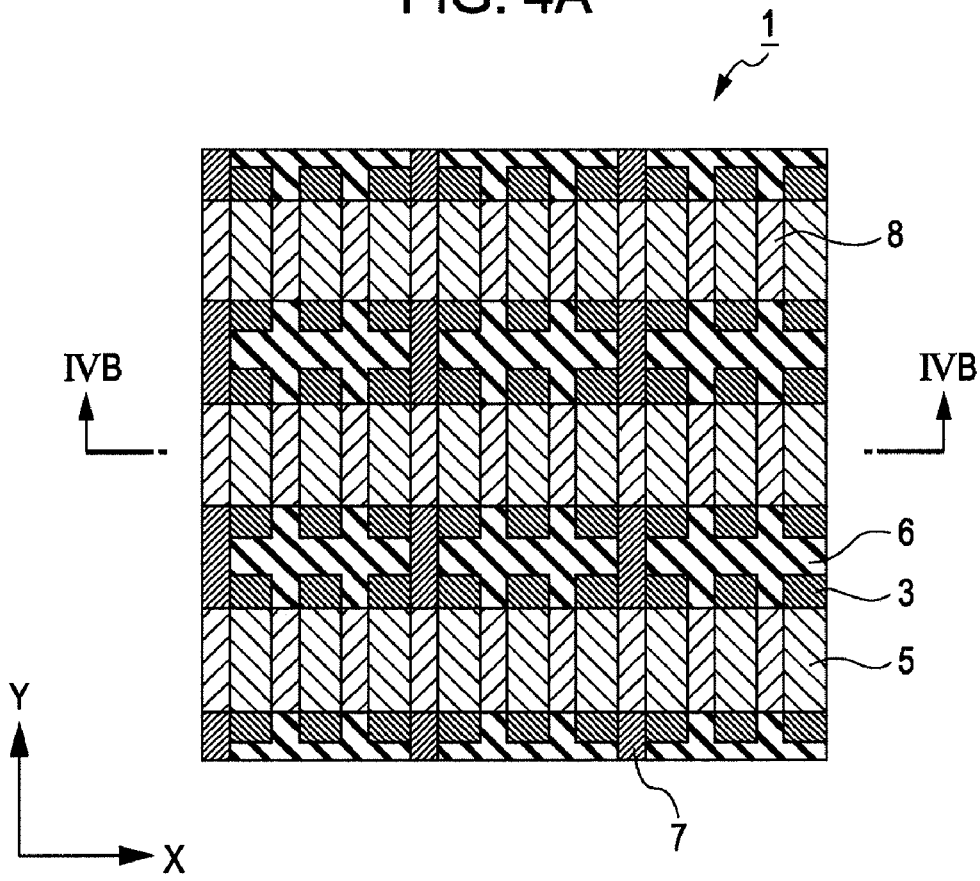
FIGS. 4A and 4B, shows respectively an inner-surface plan view and a sectional view of a light-emitting substrate according to still another exemplary embodiment of the present invention.
Figure 4B:
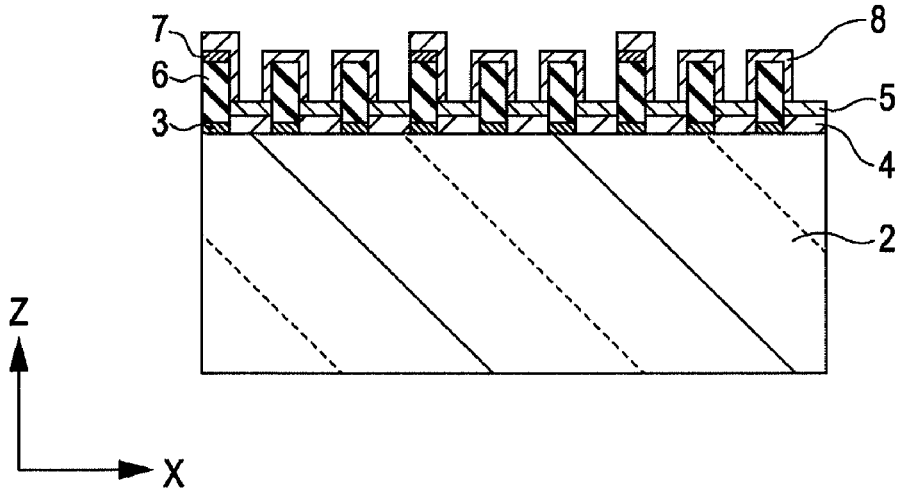

This exemplary embodiment represents an example of the light-emitting substrate shown in FIGS. 4A and 4B. FIG. 4A illustrates an inner surface of the light-emitting substrate, and FIG. 4B illustrates a cross-section thereof taken along the line IVB-IVB in FIG. 4A.

Example 3 differs from Example 2 in the following points. In Example 3, one pixel is made up of RGB phosphors and one resistor 7 is disposed per pixel. The metal backs 5 within one pixel are interconnected by the metal-back power supply members 8 applied to override the ribs 6. Also, a high-resistance paste containing small particles of indium tin oxide dispersed therein is used as a material of the resistors 7. The resistors 7 are formed in a striped pattern by screen printing. The metal-back power supply members 8 are formed by obliquely vapor-depositing aluminum films from two opposing directions one by one in sequence. At that time, a mask having additional stripes projecting in the Y direction and serving as visors can be employed such that the aluminum film is not formed on one lateral surface of each rib 6 on which the resistor 7 is disposed.

An SED is fabricated by using the light-emitting substrate 1 of Example 3, and an image is displayed by applying a voltage of 8 kV to the metal backs 5 through the resistors 7. The displayed image is satisfactory in points of having high definition and high brightness, and of causing less color mixing due to a halation. In addition, since a halation in the Y direction is also suppressed, lines in the X direction can be more clearly displayed with less blur than the lines displayed in Example 1.

Further, a test of increasing the voltage of the metal back 5 to 10 kV and applying an excessive voltage to a particular one of the electron-emitting devices so as to intentionally cause a device breakdown and to induce a discharge between the relevant electron-emitting device and the light-emitting substrate 1 has proved that a secondary discharge is not generated on the rib. Also, a discharge current is sufficiently restricted and the other electron-emitting devices surrounding the intentionally damaged electron-emitting device remain normal.

Example 4

Figure 5A:
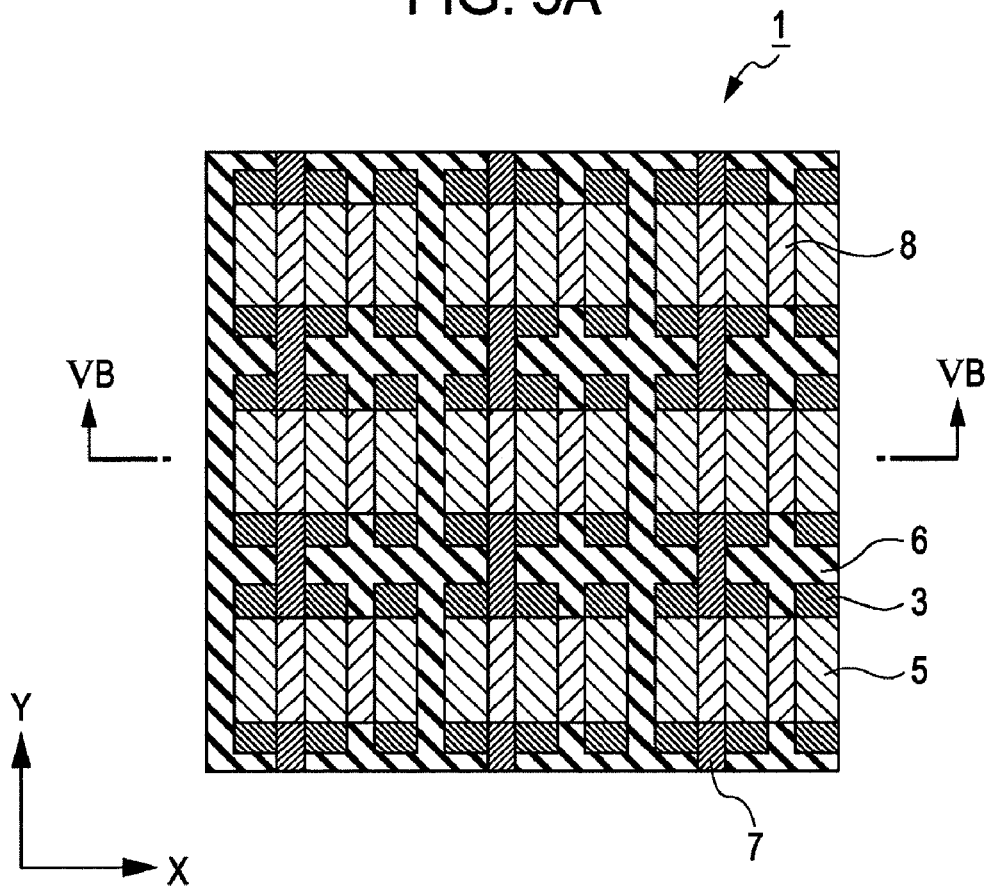
FIGS. 5A and 5B, shows respectively an inner-surface plan view and a sectional view of a light-emitting substrate according to still another exemplary embodiment of the present invention.
Figure 5B:
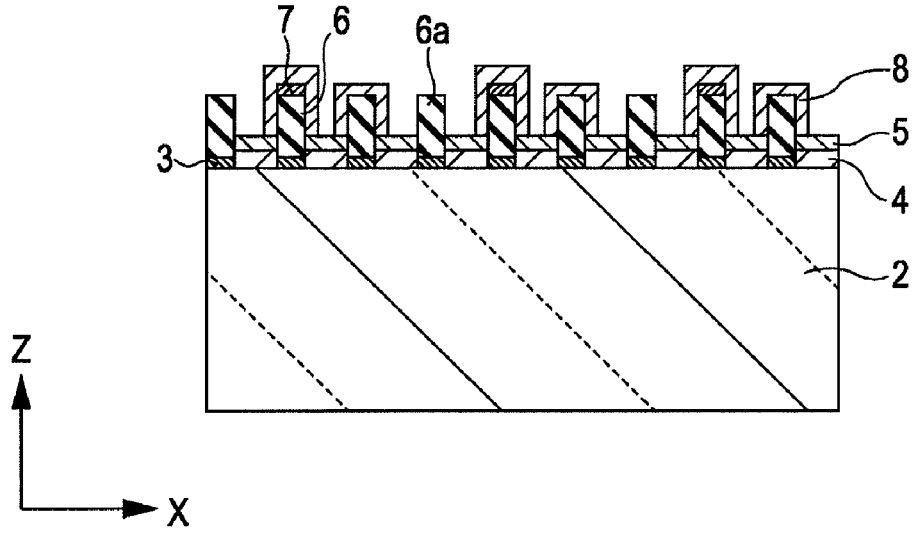

This exemplary embodiment represents an example of the light-emitting substrate shown in FIGS. 5A and 5B. FIG. 5A illustrates an inner surface of the light-emitting substrate, and FIG. 5B illustrates a cross-section thereof taken along the line VB-VB in FIG. 5A.

Example 4 differs from Example 3 in that the resistor 7 is formed on the rib disposed intermediate the metal backs which are positioned adjacent to each other and which are interconnected by the metal-back power supply members 8.

An SED is fabricated by using the light-emitting substrate 1 of Example 4, and an image is displayed by applying a voltage of 8 kV to the metal backs 5 through the resistors 7. The displayed image is satisfactory in points of having high definition and high brightness, and of causing less color mixing due to a halation. In addition, since a halation in the Y direction is also suppressed, lines in the X direction can be more clearly displayed with less blur than the lines displayed in Example 1.

Further, a test of increasing the voltage of the metal back 5 to 12 kV and applying an excessive voltage to a particular one of the electron-emitting devices so as to intentionally cause a device breakdown and to induce a discharge between the relevant electron-emitting device and the light-emitting substrate 1 has proved that a secondary discharge is not generated on the rib. Also, a discharge current is sufficiently restricted and the other electron-emitting devices surrounding the intentionally damaged electron-emitting device remain normal. Such a result is obtained from the mechanism that the withstand voltage in the X direction is increased by arranging the metal backs, which are connected to one resistor, on both sides of the relevant resistor in the X direction. Stated another way, as denoted by 6*a* in FIG. 5B, the metal-back power supply members 8 are not present at both lateral surfaces of the partition 6*a* between the metal backs which are positioned adjacent to each other, but which are electrically separated. Therefore, the creeping distance between the adjacent metal backs, which are electrically separated (i.e., not interconnected), can be increased and the withstand voltage in the X direction can be increased correspondingly.

Example 5

Figure 6A:
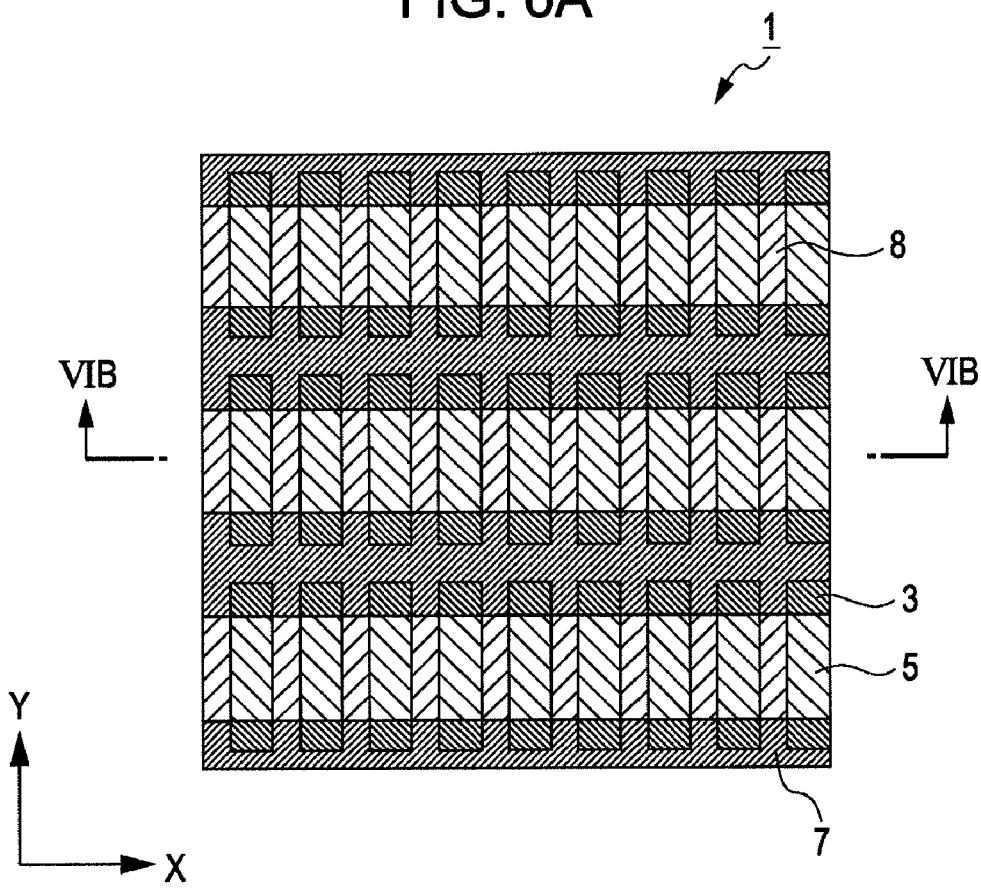
FIGS. 6A and 6B, shows respectively an inner-surface plan view and a sectional view of a light-emitting substrate according to still another exemplary embodiment of the present invention.
Figure 6B:
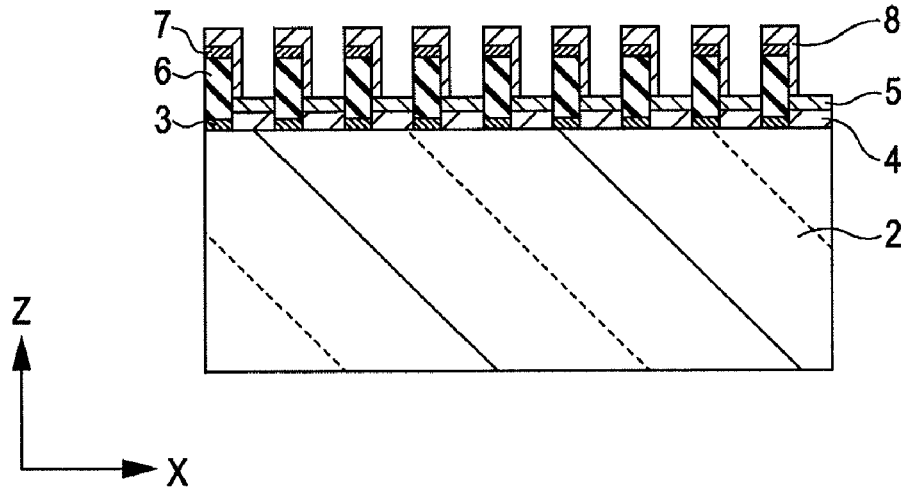

This exemplary embodiment represents an example of the light-emitting substrate shown in FIGS. 6A and 6B. FIG. 6A illustrates an inner surface of the light-emitting substrate, and FIG. 6B illustrates a cross-section thereof taken along the line VIB-VIB in FIG. 6A.

Example 5 differs from Example 2 in that the resistor 7 is additionally formed on an upper surface of the rib 6 extending in the X direction (i.e., the row direction). In other words, Example 5 employs the resistors 7 formed in a grid-like shape having stripe portions extending in the X direction (i.e., the row direction) in addition to the stripe portions extending in the Y direction (i.e., the column direction).

An SED is fabricated by using the light-emitting substrate 1 of Example 5, and an image is displayed by applying a voltage of 8 kV to the metal backs 5 through the resistors 7. The displayed image is satisfactory in points of having high definition and high brightness, and of causing less color mixing due to a halation. In addition, since a halation in the Y direction is also suppressed, lines in the X direction can be more clearly displayed with less blur than the lines displayed in Example 1.

Further, a test of increasing the voltage of the metal back 5 to 10 kV and applying an excessive voltage to a particular one of the electron-emitting devices so as to intentionally cause a device breakdown and to induce a discharge between the relevant electron-emitting device and the light-emitting substrate 1 has proved that a secondary discharge was not generated on the rib. Also, a discharge current is sufficiently restricted and the other electron-emitting devices surrounding the intentionally damaged electron-emitting device remain normal. Such a result is obtained from the mechanism that a weak current is caused to flow between the adjacent metal backs when a discharge is generated between the metal back and the electron-emitting device, whereby the potential difference between the adjacent metal backs is held small at such a level as to prevent a short circuit due to the secondary discharge.

Example 6

Figure 7A:
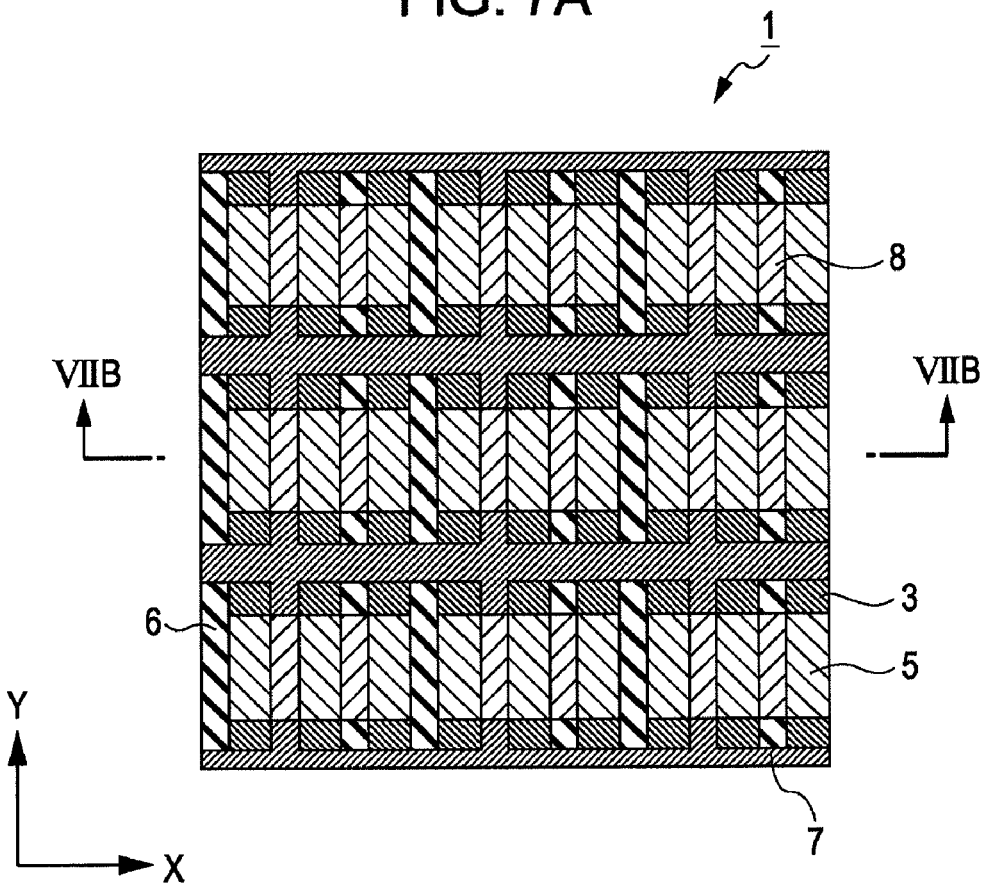
FIGS. 7A and 7B, shows respectively an inner-surface plan view and a sectional view of a light-emitting substrate according to still another exemplary embodiment of the present invention.
Figure 7B:
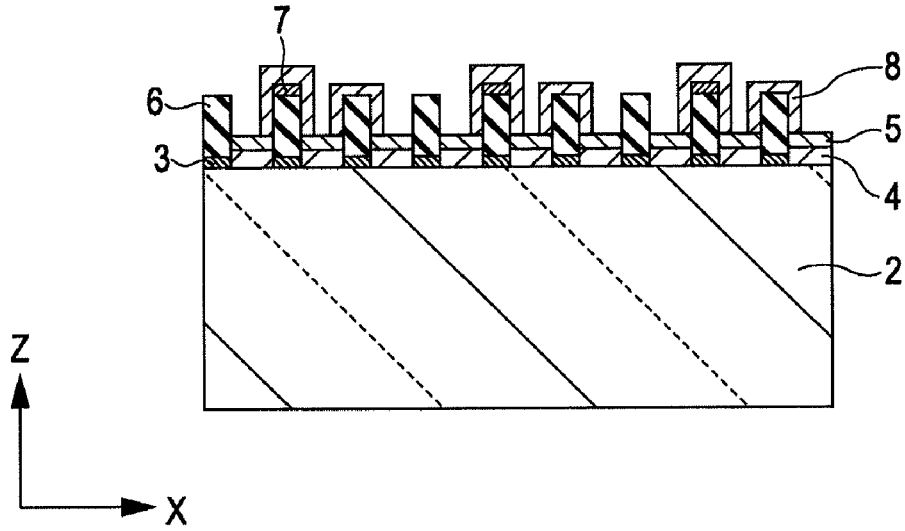

This exemplary embodiment represents an example of the light-emitting substrate shown in FIGS. 7A and 7B. FIG. 7A illustrates an inner surface of the light-emitting substrate, and FIG. 7B illustrates a cross-section thereof taken along the line VIIB-VIIB in FIG. 7A.

Example 6 differs from Example 4 in that the resistor 7 is additionally formed on an upper surface of the rib 6 extending in the X direction. In other words, Example 6 employs the resistors 7 formed in a grid-like shape having stripe portions extending in the X direction (i.e., the row direction) in addition to the stripe portions extending in the Y direction.

An SED is fabricated by using the light-emitting substrate 1 of Example 6, and an image is displayed by applying a voltage of 8 kV to the metal backs 5 through the resistors 7. The displayed image is satisfactory in points of having high definition and high brightness, and of causing less color mixing due to a halation. In addition, since a halation in the Y direction is also suppressed, lines in the X direction can be more clearly displayed with less blur than the lines displayed in Example 1.

Further, a test of increasing the voltage of the metal back 5 to 14 kV and applying an excessive voltage to a particular one of the electron-emitting devices so as to intentionally cause a device breakdown and to induce a discharge between the relevant electron-emitting device and the light-emitting substrate 1 has proved that a secondary discharge is not generated on the rib. Also, a discharge current was sufficiently restricted and the other electron-emitting devices surrounding the intentionally damaged electron-emitting device remain normal.

Example 7

Figure 10:
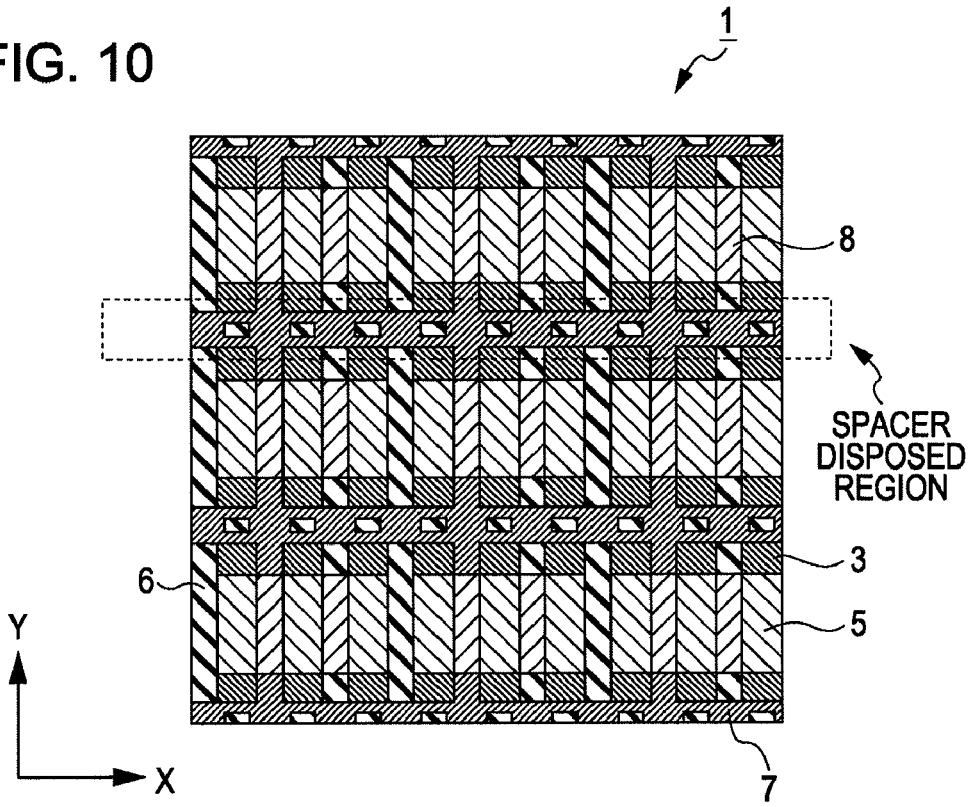
FIG. 10 illustrates an inner surface of a light-emitting substrate according to still another exemplary embodiment of the present invention.

This exemplary embodiment represents an example, shown in FIG. 10, of a light-emitting substrate adapted for the image display apparatus which uses, as shown in FIG. 9, the spacer for supporting the vacuum container against the atmospheric pressure. FIG. 10 illustrates an inner surface of the light-emitting substrate of Example 7.

Example 7 differs from Example 6 in that the resistor 7 formed on the upper surface of the rib 6 extending in the X direction (row direction) has a stripe portion extending in the row direction in a ladder-like shape.

An SED is fabricated by using the light-emitting substrate 1 of Example 7 in which the spacer 16 is disposed in abutment with the ladder-shaped stripe portion extending in the row direction. The ladder-shaped structure of the resistor 7 in Example 7 is more tolerable to a deviation of the position of the spacer 16 in the Y direction (column direction) than the structure in Example 6 in which the stripe portion of the resistor 7 extending in the row direction is formed as a single straight line.

An image is displayed by applying a voltage of 8 kV to the metal backs 5 through the resistors 7 in the image display apparatus fabricated as described above. The displayed image is satisfactory with less color mixing due to a halation. In addition, since a halation in the Y direction (column direction) is also suppressed, lines in the X direction (row direction) can be more clearly displayed with less blur than the lines displayed in Example 1.

Further, a test of increasing the voltage of the metal back 5 to 12 kV and applying an excessive voltage to a particular one of the electron-emitting devices so as to intentionally cause a device breakdown and to induce a discharge between the relevant electron-emitting device and the light-emitting substrate 1 has proved that a secondary discharge is not generated on the rib. Also, a discharge current is sufficiently restricted and the other electron-emitting devices surrounding the intentionally damaged electron-emitting device remain normal.

Example 8

Figure 11:
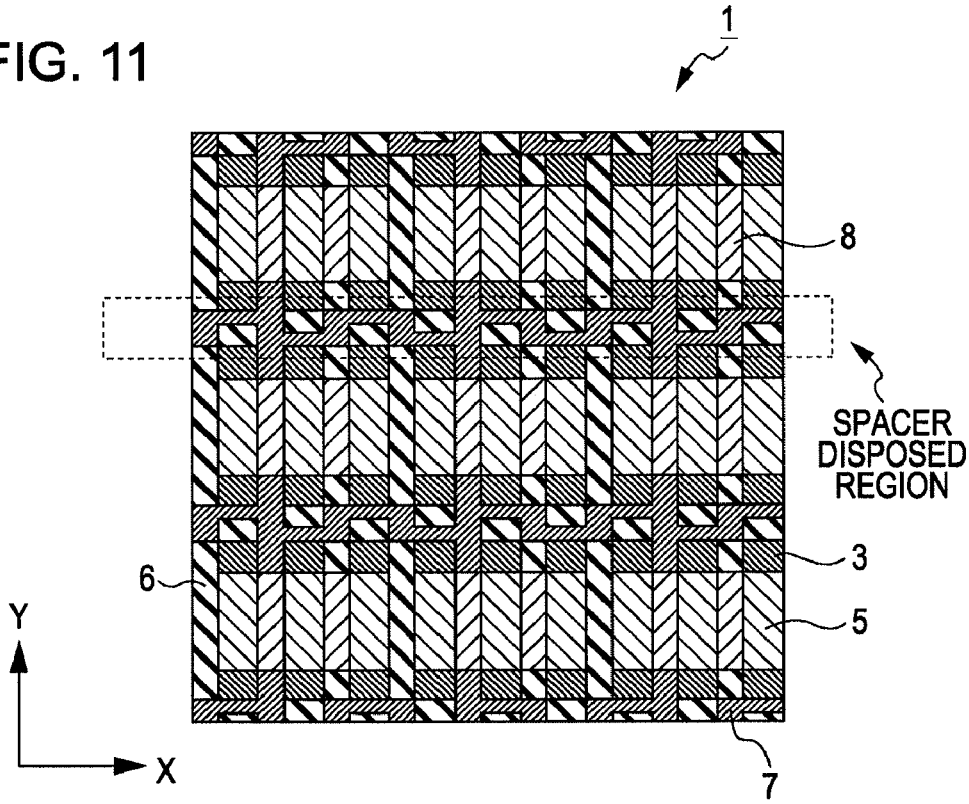
FIG. 11 illustrates an inner surface of a light-emitting substrate according to still another exemplary embodiment of the present invention.

This exemplary embodiment represents an example, shown in FIG. 11, of a light-emitting substrate adapted for the image display apparatus which uses, as shown in FIG. 9, the spacer for supporting the vacuum container against the atmospheric pressure. FIG. 11 illustrates an inner surface of the light-emitting substrate of Example 8.

Example 8 differs from Example 7 in that the resistor 7 formed on the upper surface of the rib 6 extending in the X direction (row direction) has a stripe portion extending in the row direction in the shape of a zigzag line.

An SED is fabricated by using the light-emitting substrate 1 of Example 8 in which the spacer 16 is disposed in abutment with the zigzag line-shaped stripe portion extending in the row direction. The zigzag line-shaped structure of the resistor 7 in Example 8 is more tolerable to a deviation of the position of the spacer 16 in the Y direction than the structure in Example 6 in which the stripe portion of the resistor 7 extending in the row direction is formed as a single straight line.

An image is displayed by applying a voltage of 8 kV to the metal backs 5 through the resistors 7 in the image display apparatus fabricated as described above. The displayed image is satisfactory with less color mixing due to a halation. In addition, since a halation in the Y direction is also suppressed, lines in the X direction can be more clearly displayed with less blur than the lines displayed in Example 1.

Further, a test of increasing the voltage of the metal back 5 to 12 kV and applying an excessive voltage to a particular one of the electron-emitting devices so as to intentionally cause a device breakdown and to induce a discharge between the relevant electron-emitting device and the light-emitting substrate 1 has proved that a secondary discharge is not generated on the rib. Also, a discharge current is sufficiently restricted and the other electron-emitting devices surrounding the intentionally damaged electron-emitting device remain normal.

While the present invention has been described with reference to exemplary embodiments, it is to be understood that the invention is not limited to only the disclosed exemplary embodiments. The scope of the following claims is to be accorded the broadest interpretation so as to encompass all modifications and equivalent structures and functions.

This application claims the benefit of Japanese Application No. 2007-328721 filed Dec. 20, 2007, which is hereby incorporated by reference herein in its entirety.

The invention claimed is:

1. A light-emitting substrate comprising:

a substrate;

a plurality of light-emitting members arranged on the substrate in a matrix pattern;

a partition arranged between adjacent respective ones of the plurality of light-emitting members and projecting relative to a surface of the substrate to a position higher than the light-emitting members;

a plurality of conductors each covering at least one of the light-emitting members and arranged in a matrix pattern in a mutually spaced relation; and a resistor electrically interconnecting the plurality of conductors, the resistor having at least one pair of adjacent column stripe portions extending in a column direction, without any other column stripe portion positioned between the column stripe portions of the pair, the at least one pair of adjacent column stripe portions being positioned on the partition such that two or more of the light-emitting members are positioned between the pair of adjacent column stripe portions in a row direction.

2. The light-emitting substrate according to claim 1, wherein the partition is formed in a grid-like shape.

3. The light-emitting substrate according to claim 2, wherein the resistor is formed in a grid-like shape including row stripe portions extending in a row direction and column stripe portion extending in a column direction.

4. The light-emitting substrate according to claim 1, wherein the resistor includes a thick-film resistance member having resistance reduced when the thick-film resistance member is molten.

5. The light-emitting substrate according to claim 3, wherein the row stripe portions of the resistors extending in the row direction have a ladder shape.

6. The light-emitting substrate according to claim 3, wherein the row stripe portions of the resistors extending in the row direction have a zigzag-line shape.

7. An image display apparatus comprising:

an electron source substrate including a plurality of electron-emitting devices and wirings arranged to apply voltages to the electron-emitting devices, and a light-emitting substrate, comprising:

a substrate;

a plurality of light-emitting members arranged on the substrate in a matrix pattern, the light-emitting members emitting light in response to being irradiated by electrons emitted by at least one electron-emitting device;

a partition arranged between adjacent respective ones of the plurality of light-emitting members and projecting relative to a surface of the substrate to a position higher than the light-emitting members;

a plurality of conductors each covering at least one of the light-emitting members and arranged in a matrix pattern in a mutually spaced relation; and a resistor electrically interconnecting the plurality of conductors, the resistor having at least one pair of adjacent column stripe portions extending in a column direction, without any other column stripe portion positioned between the column stripe portions of the pair, the at least one pair of adjacent column stripe portions being positioned on the partition such that two or more of the light-emitting members are positioned between the pair of adjacent column stripe portions in a row direction.

8. The image display apparatus according to claim 7, further comprising a spacer arranged between the electron source substrate and the light-emitting substrate, the spacer being electrically connected to the resistor.

* * * * *